US009970079B2

(12) United States Patent
Poole et al.

(10) Patent No.: US 9,970,079 B2
(45) Date of Patent: May 15, 2018

(54) METHODS FOR CONSTRUCTING PARTS USING METALLIC GLASS ALLOYS, AND METALLIC GLASS ALLOY MATERIALS FOR USE THEREWITH

(71) Applicant: Apple Inc., Cupertino, CA (US)

(72) Inventors: Joseph C. Poole, San Francisco, CA (US); Theodore A. Waniuk, Lake Forest, CA (US); Jeffrey L. Mattlin, San Francisco, CA (US); Michael S. Nashner, San Jose, CA (US); Christopher D. Prest, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 307 days.

(21) Appl. No.: 14/690,253

(22) Filed: Apr. 17, 2015

(65) Prior Publication Data

US 2015/0299825 A1 Oct. 22, 2015

Related U.S. Application Data

(60) Provisional application No. 61/981,649, filed on Apr. 18, 2014.

(51) Int. Cl.
*C22C 45/00* (2006.01)
*C22C 1/00* (2006.01)
(Continued)

(52) U.S. Cl.
CPC ..... *C22C 1/002* (2013.01); *B22F 7/02* (2013.01); *C21D 1/18* (2013.01); *C21D 1/38* (2013.01);
(Continued)

(58) Field of Classification Search
None
See application file for complete search history.

(56) References Cited

U.S. PATENT DOCUMENTS 4,386,896 A * 6/1983 Ray ..... B01J 2/04 425/7
5,288,344 A 2/1994 Peker et al.
(Continued)

FOREIGN PATENT DOCUMENTS

| | | |
|---|---|---|
| JP | 2001-303218 | 10/2001 |
| JP | 2009-173964 | 5/2009 |
| JP | 2014-058716 | 4/2014 |

OTHER PUBLICATIONS

Shen et al., "Bulk Glassy $Co_{43}Fe_{20}Ta_{5.5}B_{31.5}$ Alloy with High Glass-Forming Ability and Good Soft Magnetic Properties," *Materials Transactions*, vol. 42, No. 10 (2001) pp. 2136-2139.
(Continued)

*Primary Examiner* — George Wyszomierski
(74) *Attorney, Agent, or Firm* — Polsinelli PC

(57) ABSTRACT

Described herein are methods of constructing a three-dimensional part using metallic glass alloys, layer by layer, as well as metallic glass-forming materials designed for use therewith. In certain embodiments, a layer of metallic glass-forming powder or a sheet of metallic glass material is deposited to selected positions and then fused to a layer below by suitable methods such as laser heating or electron beam heating. The deposition and fusing are then repeated as need to construct the part, layer by layer. One or more sections or layers of non-metallic glass material can be included as needed to form composite parts. In one embodiment, the metallic glass-forming powder is a homogenous atomized powder. In another embodiment, the metallic glass-forming powder is formed by melting a metallic glass alloy to an over-heat threshold temperature substantially
(Continued)

above the $T_{liquidus}$ of the alloy, and quenching the melt at a high cooling rate such that the cooling material is kept substantially amorphous during cooling to form the metallic glass. In various embodiments, the melt is atomized during cooling to form the metallic glass-forming powder.

18 Claims, 5 Drawing Sheets

(51) Int. Cl.

| | |
|---|---|
| ***C21D 1/18*** | (2006.01) |
| ***B22F 7/02*** | (2006.01) |
| ***C23C 24/10*** | (2006.01) |
| ***C21D 1/38*** | (2006.01) |
| *H01F 1/153* | (2006.01) |

(52) U.S. Cl.
CPC ..... *C22C 45/00* (2013.01); *C23C 24/106* (2013.01); *C21D 2251/00* (2013.01); *H01F 1/15308* (2013.01)

(56) References Cited

U.S. PATENT DOCUMENTS 5,368,659 A 11/1994 Peker et al.
5,576,884 A 11/1996 Ise et al.
5,618,359 A 4/1997 Lin et al.
5,647,921 A * 7/1997 Odagawa ..... B22D 11/0611 148/304
5,711,363 A 1/1998 Scruggs et al.
5,735,975 A 4/1998 Lin et al.
6,086,651 A * 7/2000 Mizushima ..... A63B 53/04 148/304
6,325,868 B1 12/2001 Kim et al.
6,749,700 B2 * 6/2004 Sunakawa ..... C22C 45/02 148/561
7,575,040 B2 8/2009 Johnson
2001/0028245 A1 10/2001 Li et al.
2004/0046481 A1 3/2004 Takeuchi et al.
2006/0157164 A1 * 7/2006 Johnson ..... C22C 45/003 148/403
2006/0254386 A1 * 11/2006 Inoue ..... B22F 3/006 75/246
2007/0003782 A1 1/2007 Collier
2007/0079907 A1 4/2007 Johnson et al.
2007/0111119 A1 5/2007 Hu et al.
2007/0267111 A1 11/2007 Fleury et al.
2007/0290339 A1 12/2007 Suh et al.
2008/0118387 A1 5/2008 Demetriou et al.
2008/0185188 A1 * 8/2008 Blue ..... C23C 24/08 175/374
2008/0209976 A1 9/2008 Deneuville
2009/0139858 A1 * 6/2009 Nakamura ..... B01D 67/0072 204/298.13
2009/0246549 A1 10/2009 Jang et al.
2010/0084052 A1 4/2010 Farmer et al.
2010/0230012 A1 9/2010 Demetriou et al.
2010/0300148 A1 12/2010 Demetriou et al.
2010/0310901 A1 12/2010 Making et al.
2011/0165339 A1 7/2011 Skoglund et al.
2012/0174976 A1 * 7/2012 Kim ..... H01B 1/026 136/256
2012/0247948 A1 * 10/2012 Shin ..... C23C 14/025 204/192.1
2012/0312061 A1 12/2012 Pham et al.
2012/0325051 A1 * 12/2012 Watson ..... B22F 9/002 75/338
2013/0139964 A1 6/2013 Hofmann et al.
2013/0309121 A1 11/2013 Prest et al.
2014/0007983 A1 1/2014 Prest et al.
2014/0334106 A1 11/2014 Prest et al.
2015/0202841 A1 7/2015 Verreault et al.
2015/0267286 A1 9/2015 Na et al.
2015/0314566 A1 11/2015 Poole et al.
2015/0315678 A1 11/2015 Poole et al.
2015/0315687 A1 11/2015 Poole et al.
2016/0024630 A1 1/2016 Weber et al.

OTHER PUBLICATIONS

Inoue et al., "Bulk Amorphous Alloys with High Mechanical Strength and Good Soft Magnetic Properties in Pe-TM-B (TM=IV-VII Group Transition Metal) System," *Appl. Phys. Lett.*, vol. 71, (1997) pp. 464.
Hays et al., "Microstructure Controlled Shear Band Pattern Formation and Enhanced Plasticity of Bulk Metallic Glasses Containing in situ Formed Ductile Phase Dendrite Dispersions," *Physical Review Letters*, Mar. 2000, Vo.. 84, No. 13, pp. 2901-2904.
Conner et al., "Mechanical Properties of Tungsten and Steel Fiber Reinforced $Zr_{41.25}Ti_{13.75}Cu_{12.5}Ni_{10}Be_{22.5}$ Metallic Glass Matrix Composites," *Acta mater.*, 1998, vol. 46, No. 7, pp. 6089-6102.
Kato et al., "Relationship between thermal expansion coefficient and glass transition temperature in metallic glasses," *Scripta Materialia*, 2008, vol. 58, pp. 1106-1109.
Shackelford, James R. Alexander, William CRC Materials Science and Engineering Handbook, (2001), Taylor & Francis, (3rd Edition), Table 112.

* cited by examiner

METHODS FOR CONSTRUCTING PARTS USING METALLIC GLASS ALLOYS, AND METALLIC GLASS ALLOY MATERIALS FOR USE THEREWITH

CROSS-REFERENCE TO RELATED APPLICATIONS

The present application claims the benefit of U.S. Provisional Patent Application No. 61/981,649, entitled "Method for Constructing Three-Dimensional Parts Using Metallic Glass Alloys, and Metallic Glass Alloy Materials for Use Therewith," filed on Apr. 18, 2014, which is incorporated herein by reference in its entirety.

FIELD

The present disclosure is directed to methods of constructing three-dimensional parts using metallic glass alloys, and metallic glass alloy materials for use therewith.

BACKGROUND

Bulk-solidifying amorphous alloys, also referred to as metallic glass-forming alloys or bulk metallic glasses ("BMGs") have been made in a variety of metallic systems. They are generally prepared by quenching from above the melting temperature to the ambient temperature. Generally, high cooling rates, such as on the order of $10^{5}$° C./sec to $10^{3}$° C./sec, are needed to achieve an amorphous structure. The lowest rate by which a BMG can be cooled to avoid crystallization, thereby achieving and maintaining the amorphous structure during cooling, is referred to as the critical cooling rate for the bulk alloy. In order to achieve a cooling rate higher than the critical cooling rate, heat has to be extracted from the sample. The thickness of articles made from metallic glass-forming alloys often becomes a limiting dimension, which is generally referred to as the critical (casting) thickness.

There exists a need for methods of constructing three-dimensional parts using bulk metallic glasses or metallic glass-forming alloys, as well as a need for BMG forming materials designed for use in such methods.

SUMMARY

Described herein are methods of making a heat-treated metallic glass-forming alloy. The alloy can be used to make metallic glass alloys by any number of methods. In some variations, the metallic glass-forming alloys can be powder that can be used to make structures layer by layer.

In one aspect, the method is directed forming a metallic glass-forming alloy. A metallic glass-forming alloy is heated to a temperature over the $T_{liquidus}$ of the alloy to form a metallic glass-forming alloy melt. The metallic glass-forming alloy melt is quenched to a temperature below the glass-transition temperature at a cooling rate sufficiently rapid to prevent crystallization of the alloy. The alloy can then form a heat-treated metallic glass-forming alloy. The alloy can be crystalline, amorphous, or a combination of both.

In accordance with certain aspects, parts can be formed using layer deposition of metallic glasses. In one aspect, a layer of metallic glass-forming alloy can be deposited to selected positions and then fused to a layer below by suitable methods such as laser heating or electron beam heating. The deposition and fusing are then repeated as needed to construct the part, layer by layer.

In instances where a metallic glass-forming powder is used, the powder can be an atomized metallic glass-forming powder. In certain aspects, the metallic glass-forming powder is a homogenous atomized metallic glass-forming powder. For instance, a metallic glass-forming alloy may be atomized during cooling to form an atomized metallic glass-forming powder, and the atomized metallic glass-forming powder may be mixed to provide a homogenous atomized metallic glass-forming powder.

In another embodiment, an alloy melt is formed by melting a metallic glass-forming alloy to an over-heat threshold temperature, substantially above the $T_{liquidus}$ of the alloy, and quenching the alloy melt at a high cooling rate such that the cooling material is kept amorphous during cooling to form the metallic glass-forming alloy. Quenching the alloy melt is done at a cooling rate sufficiently rapid to prevent crystallization of the alloy. In some embodiments, cooling rates, such as at least $10^{3}$° C./sec, alternatively at least $10^{4}$° C./sec, or alternatively at least $10^{5}$° C./sec, can be used to achieve an amorphous structure and prevent crystallization. In certain embodiments, the over-heat threshold temperature is above $T_{GFA}$, the temperature associated with substantial improvement in glass-forming ability compared to the glass-forming ability demonstrated by heating the melt just above $T_{liquidus}$. In certain embodiments, the melt is atomized during cooling to form an atomized metallic glass-forming alloy.

In certain embodiments, one or more sections or layers of material that is not metallic glass can be included as needed to form a composite final part. For instance, sections or layers of non-amorphous material, Kevlar fiber, and/or non-heated BMG forming alloy, can be included to form composite parts.

BRIEF DESCRIPTION OF FIGURES

Although the following figures and description illustrate specific embodiments and examples, the skilled artisan will appreciate that various changes and modifications may be made without departing from the spirit and scope of the disclosure.

DETAILED DESCRIPTION

Figure 1:
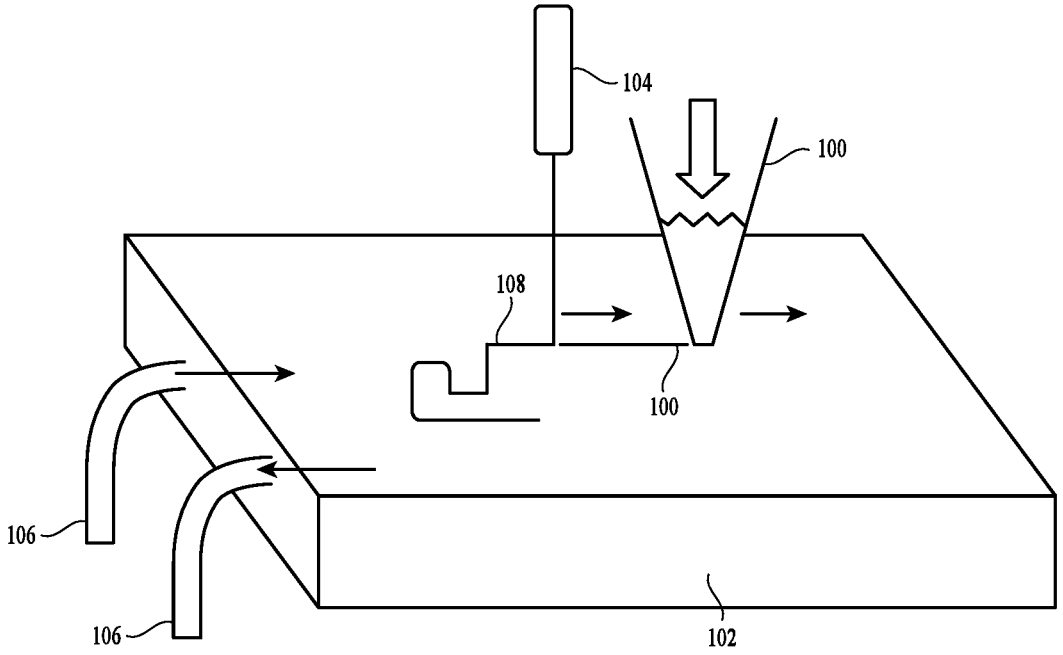
FIG. 1 depicts an exemplary method of constructing a part from metallic glass-forming powder layer by layer.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

Metallic glass-forming alloys, bulk-solidifying amorphous alloys, metallic glass-forming alloys or bulk metallic glasses ("BMG"), are a class of metallic materials. These alloys may be solidified and cooled at relatively slow rates, and they retain the amorphous, non-crystalline (i.e., glassy) state at room temperature. Metallic glass-forming alloys have many superior properties compared to their crystalline counterparts. However, if the cooling rate is not sufficiently high, crystals may form inside the alloy during cooling, so that the benefits of the amorphous state can be lost. For example, one challenge with the fabrication of bulk metallic glass-forming alloy parts is partial crystallization of the parts due to either slow cooling or impurities in the raw alloy material. As a high degree of amorphicity (and, conversely, a low degree of crystallinity) is desirable in bulk metallic glass parts, there is a need to develop methods for casting bulk metallic glass parts having controlled amount of amorphicity.

In accordance with the present disclosure, methods of constructing a three-dimensional part using metallic glass-forming alloys, layer by layer (i.e. printing or layer deposition) are provided. In certain aspects, a layer of metallic glass-forming alloy (in a form such as a powder, wire, or sheet), whether crystalline, metallic glass, or combination of both, is deposited to selected positions, and then fused to a layer below by suitable methods such as laser heating or electron beam heating. Specific regions can be heated by techniques such as selective laser melting (SLM). The deposition and fusing are then repeated as need to construct the part, layer by layer. In certain aspects, methods and final parts are improved by providing metallic glass-forming powders, wires, or sheets of metallic glass material and optional non-metallic glass materials with desired properties.

The metallic glass-forming alloy may comprise a metallic glass-forming alloy, or a mixture of alloys, or constituent elements or precursors of metallic glass-forming alloys (master alloys), as described in further detail herein.

In certain embodiments, a homogenous atomized metallic glass-forming powder is provided. In certain aspects, such powders may provide improved glass-forming ability and repeatability of quality of final parts. Metallic glass-forming alloys are sensitive to compositional variations, with changes as little as 0.1 wt % affecting the glass-forming ability (GFA) of an alloy. For instance, metallic glass-forming alloys are generally composed of at least three, four, or more, different elements, which sometimes have very different densities, creating potential issues with solubility and compositional homogeneity.

To address these potential issues, in certain aspects, the metallic glass-forming powder is a homogenous atomized powder. For instance, a metallic glass-forming alloy may be gas atomized during cooling to form an atomized powder, and the atomized powder may be mixed in any suitable manner known in the art, e.g., mechanical mixing, to provide a homogenous atomized metallic glass-forming powder. In certain aspects, homogenous atomized metallic glass-forming powders are useful in the methods described herein to provide repeatability of quality of final parts, as compared to final parts prepared using metallic glass-forming powder with homogeneous properties formed from sectioning and re-melting alloy ingots.

In various aspects, the metallic glass-forming alloy can be overheated to a temperature above $T_{liquidus}$. In another embodiment, a metallic glass-forming alloy is formed by melting a metallic glass-forming alloy to an over-heat threshold temperature, substantially above the $T_{liquidus}$ of the alloy, and quenching the alloy melt at a high cooling rate such that the cooling material is kept amorphous during cooling to form the metallic glass-forming alloy. In certain embodiments, the melt is atomized during cooling to form an atomized BMG forming powder. The melt overheating temperature will be substantially greater than the $T_{liquidus}$ of the alloy. For instance, in certain embodiments, the over-heat threshold temperature is at least about 25% above $T_{liquidus}$ of the alloy, 40% above $T_{liquidus}$ of the alloy, 100% above $T_{liquidus}$ of the alloy, or higher. The overheat threshold temperature percentages above $T_{liquidus}$ can be measured in degrees Celcius. It will be understood by those of skill in the art that the overheating temperature can depend on impurity levels, evaporation of certain substituents, etc. In certain embodiments, the over-heat threshold temperature is at least about 100 degrees Celcius above $T_{liquidus}$ of the alloy, at least about 150 degrees Celcius above $T_{liquidus}$ of the alloy, at least about 200 degrees Celcius above $T_{liquidus}$ of the alloy, or higher. It will be understood by those of skill in the art that the overheating temperature can depend on impurity levels, evaporation of certain substituents, etc.

In certain embodiments, the over-heat threshold temperature is above $T_{GFA}$, the temperature associated with substantial improvement in glass-forming ability compared to the glass-forming ability demonstrated by heating the melt just above $T_{liquidus}$. In some embodiments, the glass-forming ability and/or toughness of the metallic glass-forming alloy can be increased by at least about 10% compared to the respective values obtained in the absence of overheating above $T_{liquidus}$. In some embodiments, the glass-forming ability and/or toughness of the metallic glass-forming alloy can be increased by at least about 100% compared to the respective values obtained in the absence of overheating above $T_{liquidus}$. In some embodiments, the glass-forming ability and/or toughness of the metallic glass-forming alloy can be increased by at least 200% compared to the respective values obtained in the absence of overheating above $T_{liquidus}$. Glass-forming ability may be evaluated in any suitable manner known in the art.

More particularly, metallic glass-forming alloys exhibit an improved GFA when the alloy is melted above a threshold temperature (over-heat temperature) which is substantially above the $T_{liquidus}$ of the alloy. Without intending to be limited by theory, one reason for the effect is that by overheating the melt, certain oxide, carbide and other solid impurity inclusions are dissolved into the melt, and therefore cannot serve as heterogeneous nucleation sites for crystals. If the alloy is kept amorphous on cooling and these crystalline impurities are not allowed to come out of solution when the alloy is subsequently melted (by controlling the times and temperatures), then the alloy can retain its improved glass-forming ability for additional melt cycles.

After quenching, the metallic glass-forming heat treated alloy can be amorphous, crystalline, or a mixture of both amorphous and crystalline. For example, the quenching step can performed at a cooling rate sufficiently rapid to result in an amorphous alloy. Alternatively, the quenching step can be performed at a rate sufficiently slow to produce a crystalline alloy. The quenching rate can be at a rate such that a portion of the alloy can be crystalline and a portion can be amorphous.

The heat-treated metallic glass-forming alloy can be in any form, such as an ingot, powder, wire, or sheet. When a powder, the heat-treated metallic glass can form an ingot followed by atomization, or the heat-treated metallic glass can be atomized from the molten state.

In an atomization process, the cooling rate which each element of an alloy sees is very high due to the small particle size and large surface area for thermal heat transfer. The atomization process can include gas atomization techniques that involve dispensing the molten metallic glass-forming alloy through a nozzle or other orifice and introducing into the molten metallic glass-forming alloy a stream of inert gas just before the molten alloy leaves the nozzles. Atomizing gases may also be subject to rapid expansion through nozzles, causing them to be at low temperature (e.g., below 0° C.) when impinging on the molten alloy, which will further increase the cooling rates. Due to this high cooling rate, an alloy that is atomized is very likely to be highly amorphous (high viscosity is reached before crystals are able to nucleate and grow). In various embodiments, the atomizing gas can be argon or other inert gas. In other embodiments, the atomization process can include water or other liquid atomization, and in still other embodiments, the atomization process can include centrifugal atomization. Liquid atomization can be used, for example with less reactive metallic glasses. Liquid atomization can be less expensive and/or have higher yield compared to gas atomization processes.

The resulting heat treated metallic-glass-forming alloy can be in any form, including ingots, wires, metal spun sheets, or particles. The alloy can be an amorphous wire, and be cut into lengths. The resulting heat treated metallic glass-forming alloy can be an amorphous feedstock produced by any method known in the art. In some embodiments, the heat treated metallic glass-forming alloy is an amorphous metal feedstock that is heated to a temperature near the glass-forming temperature (Tg). In such embodiments, the atmosphere may or may not be controlled. In various embodiments, the amorphous feedstock can be ground or milled into particles.

In some aspects, the feedstock can be an amorphous wire. Such amorphous wires can be used in place of a metallic glass-forming powder in deposition methods.

As such, in accordance with certain aspects, metallic glass-forming alloys subject to overheating may provide improved glass-forming ability, reduced processing requirements, and improved final part properties. For instance, in accordance with the methods disclosed herein, a metallic glass-forming powder subject to overheating may provide improved glass-forming ability without the need to overheat during deposition and heating (i.e., melting during printing), thereby reducing laser power and scan time. Further, the thermal stresses may be reduced in the final three-dimensional part.

The heat-treated metallic glass-forming alloys can be used in methods of forming metallic glasses. In various embodiments, the heat treated alloys can be used in equal channel angular extrusion processes, spark plasma sintering, and layer deposition methods.

FIG. 1 depicts an exemplary method of constructing a metallic glass part using a platen, an outlet that deposits metallic glass-forming powder on the platen, and a heat source. According to an embodiment as shown in FIG. 1, a metallic glass-forming powder 100 can be deposited to selected positions on a platen 102 and heated (e.g., within 0.1 second, 0.5 second, 1 second or 5 seconds from the time the powder contacts a layer below) by a suitable heater 104 (e.g. a laser or electron beam) so as to fuse the powder to a layer below. The powder is heated to a temperature above its melting temperature. The platen 102 can reduce the thermal exposure of particles that have been previously layered, thereby reducing the likelihood that such particles can be converted to crystalline form during formation of additional layers. The resulting metallic glass-forming powder can be fused to form fused metallic glass 108.

Numerous variations of the device are possible. For example, as will be understood by those of skill in the art, the initial and final layers of material may or may not be processed in the same manner. Further, a wire or sheet may be used instead of a powder. The platen may move or be stationary, or components dispensing the metallic glass can move or be stationary. Alternatively, the platen surface can be covered with the metallic glass-forming alloy, and the alloy can be heated (e.g. by a laser or electron beam) at the positions at which a metallic glass is to be created.

In various embodiments, the platen can be temperature regulated. In some embodiments, the platen as described in various embodiments herein can be cooled, for example, by cooling lines, through which a cooling fluid such as water or a gas can be flowed. Alternatively, the platen can be cooled by thermoelectric cooling methods. In other embodiments, the platen can be a passive heat sink. Alternatively, the platen can be heated. Without wishing to be limited to any mechanism or mode of action, the platen can be heated to reduce or avoid increase of internal stress within the metallic glass on formation.

The metallic glass-forming powder can be deposited from any suitable outlet, such as a nozzle. In one embodiment, the powder can be deposited from a plurality of outlets, movement of each of which can be independently or collectively controlled. The heater can be any suitable heater such as a laser, electron beam, ultrasonic sound wave, infrared light, etc. The powder can be deposited onto the selected positions by moving the outlet, moving the platen or both so that the outlet is positioned at the selected positions relative to the platen. Flow of the powder from the outlet can be controlled by a shutter or valve. The movement of the outlet and/or platen, and the shutter or valve can be controlled by a computer. A part of a desired shape can be constructed by depositing and fusing the powder layer by layer. According to an embodiment, the fused powder can be smoothened by a suitable method, such as polishing and grinding, before the next layer of powder is deposited thereon.

In accordance with certain embodiments, composite parts may be formed by depositing one or more layers of non-metallic glass-forming materials. For instance, one or more layers material that is not a metallic glass (e.g., non-heated metallic glass-forming powder, non-amorphous materials, Kevlar fibers, plastic, ceramic or other insulators, other metals or semi-conductors) can be similarly deposited and fused on to a layer of amorphous metal below. In various configurations, the powder can be dispensed with two or more nozzles. In further configuration and alternative to layering, a nozzle can dispense individual granules of crystalline material to create a matrix composite.

Figure 2:
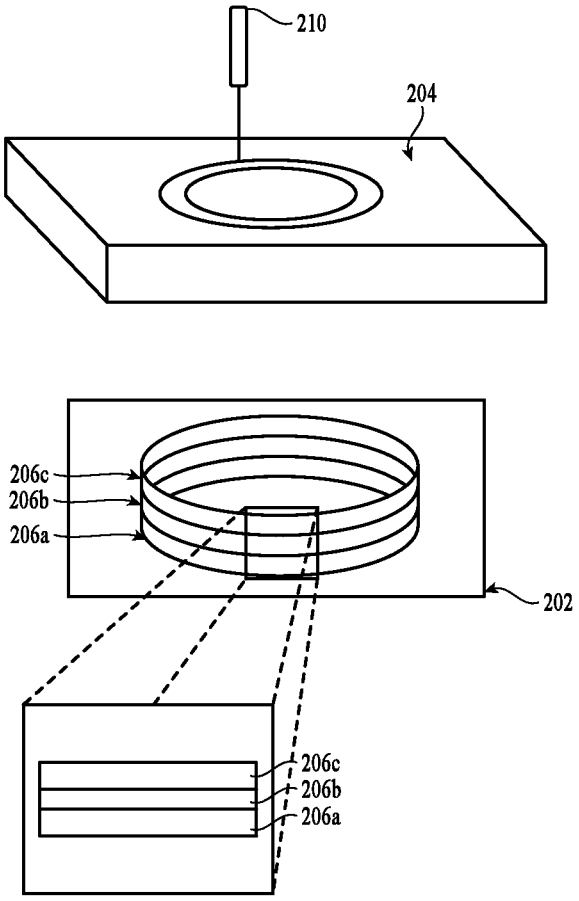
FIG. 2 depicts an exemplary method of constructing a part from metallic glass sheets layer by layer.

FIG. 2 shows an exemplary part made from metallic glass and non-metallic glass-forming powder or sheets layer by layer. Metallic glass-forming feedstock 204 is cut using laser cutting tool 210. This cutting is repeated for each layer 206*a*, 206*b*, and 206*c*. Stacked layers 206*a*, 206*b*, and 206*c* can be fused by applying heat and/or pressure using any suitable method such as hot pressing, laser irradiation, electron beam irradiation, induction heating while the stacked layers 206*a* and 206*b* are on a platen 202. Though three layers are depicted in FIG. 2, any number of layers can be fused using the described method.

Figure 3:
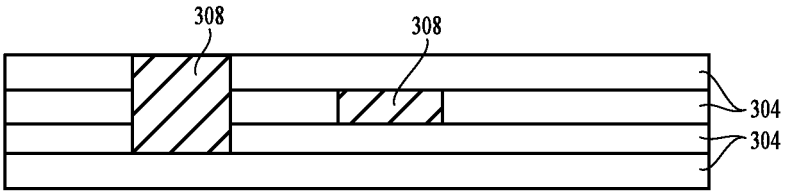
FIG. 3 depicts an exemplary composite part made from metallic glass-forming and non-metallic glass-forming powder or sheets layer by layer.

In an alternative embodiment as shown in FIG. 3, a plurality of layers of metallic glass material can be cut by a suitable method such as laser and die cutting, from one or more layers of metallic glass material 304 formed from the metallic glass-forming powder described herein. The layers of metallic glass correspond to cross-sections of a part to be made. The plurality of layers of metallic glass and optionally one or more non-metallic glass layers 302 (e.g., non-heated metallic glass-forming powder, non-amorphous materials, crystalline material, Kevlar fibers, plastic, ceramic or other insulators, other metals or semi-conductors) can then be stacked in desired spatial relations among the layers onto a platen and fused to form the part.

Without intending to be limited by theory, metallic glass material may be sensitive to oxygen content. For instance, oxides within an alloy may promote nucleation of crystals thereby detracting from formation of an amorphous microstructure. Some metallic glass-forming alloy compositions form persistent oxide layers, which may interfere with the fusion of particles. Further, surface oxides may also be incorporated into the bulk metallic glass-forming alloy and may degrade the glass-forming ability of the alloy.

Figure 4A:
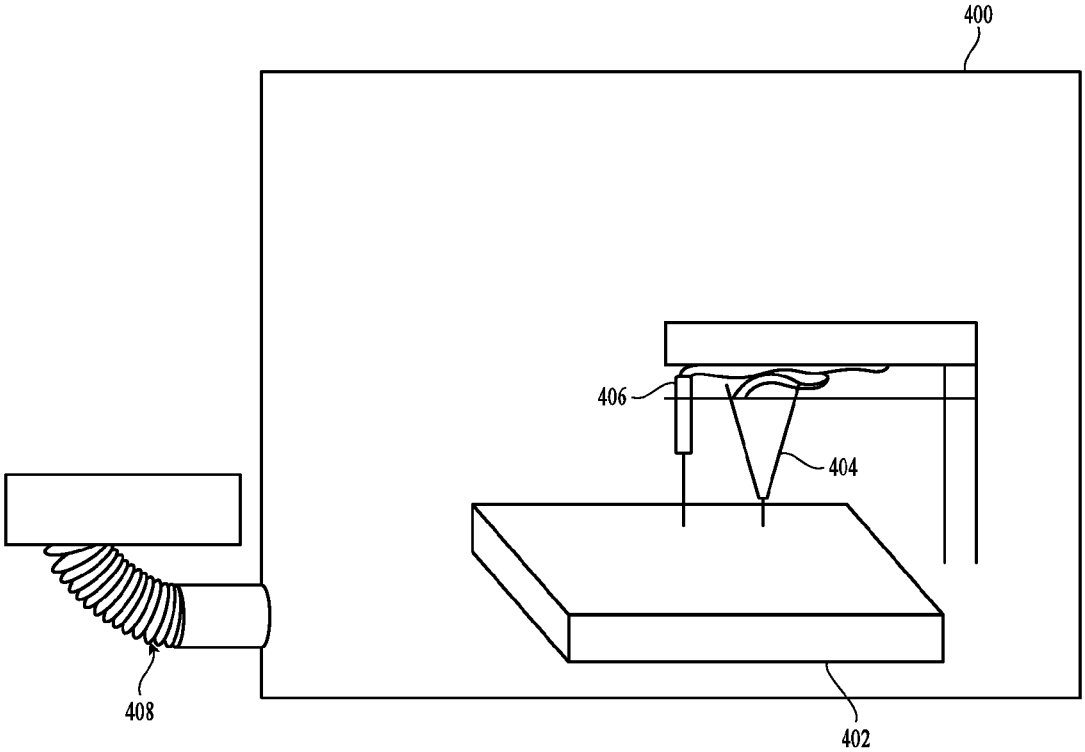
FIG. 4A depicts an exemplary enclosure for providing a vacuum, inert or reducing atmosphere.
Figure 4B:
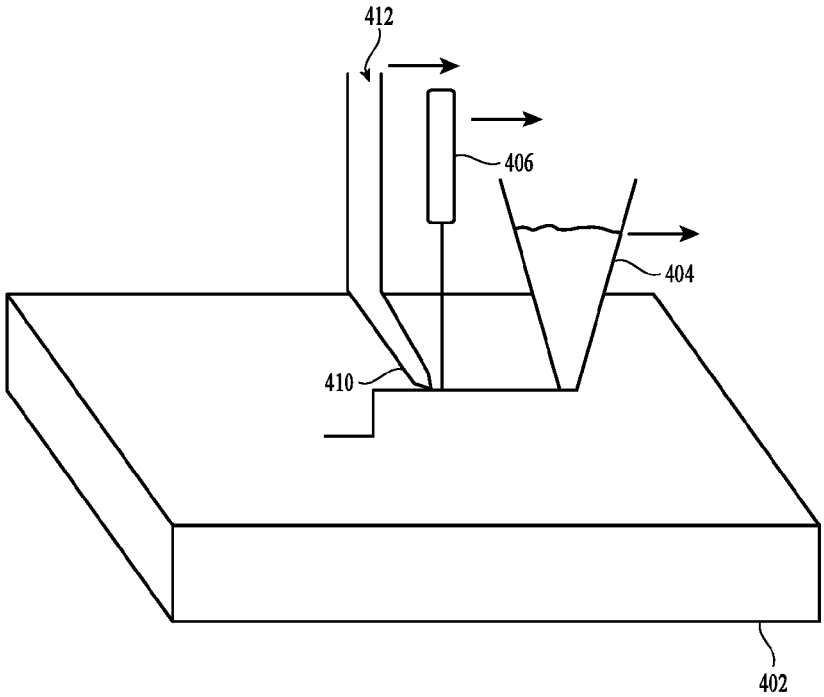
FIG. 4B depicts an exemplary scheme to locally provide an inert or reducing atmosphere.

As such, in certain embodiments, it may be desirable to protect the as-deposited powder (or sheets of metallic glass material, not shown) in an inert atmosphere, a reducing atmosphere or in vacuum when the powder is being heated, to remove oxygen from particle interfaces and from the final part. As shown in FIG. 4A, the platen 403, the outlet 404 and the heater 406 can be in an enclosure 400 placed under a vacuum (e.g., 1-10 mTorr) by evacuation pump 408, a reducing atmosphere (e.g., hydrogen or a mixture of hydrogen and nitrogen), or an inert atmosphere (e.g., argon, nitrogen, or other inert gases). The enclosure can be pumped by an evacuation pump. Alternatively, as shown in FIG. 4B, in a non-enclosed system inert gas 412 can be locally flowed to the powder (or alternatively sheets of metallic glass material, not shown) being heated by the heater.

The selective heating methods described herein can be used to form specific metallic glass structures. These structures can have mechanical properties, including increased hardness, over conventional materials known in the art.

In various embodiments, the platen can be cooled by any suitable method such as flowing liquid or gas therethrough, e.g., water cooling, gas cooling, or thermal electric cooling. The platen can be cooled at a sufficiently high rate to ensure that the fused powder is maintained as fully amorphous (or its desired amorphous state). As discussed herein, amorphous metals can be crystallized by high temperature/time exposures. In this regard, a layer may have an amorphous microstructure when first melted following deposition and heating according to a method described herein. However, without controlled cooling, the amorphous metal may be transformed to a crystalline microstructure during deposition and heating of subsequent layers due to heat conduction.

In embodiments herein, the existence of a supercooled liquid region in which the bulk metallic glass can exist as a high viscous liquid allows for superplastic forming. Large plastic deformations can be obtained. The ability to undergo large plastic deformation in the supercooled liquid region is used for the forming and/or cutting process. As opposed to solids, the liquid bulk solidifying metallic glass-forming alloy deforms locally, which drastically lowers the required energy for cutting and forming. The ease of cutting and forming depends on the temperature of the alloy, the mold, and the cutting tool. As the temperature becomes higher, the viscosity of the melt becomes lower, and cutting and forming can be easier.

Embodiments herein can utilize a thermoplastic-forming process with metallic glass-forming alloys carried out between Tg and Tx, for example. Herein, Tx and Tg are determined from standard DSC measurements at typical heating rates (e.g. 20° C./min) as the onset of crystallization temperature and the onset of glass transition temperature.

The parameters used in the printing methods described herein can depend on the metallic glass-forming alloy. The metallic glass-forming alloy components can have the critical casting thickness and the final three-dimensional part can have thickness that is thicker than the critical casting thickness. Moreover, the time and temperature of the heating and shaping operation is selected such that the elastic strain limit of the metallic glass-forming alloy could be substantially preserved to be not less than 1.0%, and preferably not being less than 1.5%. In the context of the embodiments herein, temperatures around glass transition means the forming temperatures can be below glass transition, at or around glass transition, and above glass transition temperature, but preferably at temperatures below the crystallization temperature Tx. The cooling step is carried out at rates similar to the heating rates at the heating step, and preferably at rates greater than the heating rates at the heating step. The cooling step is also achieved preferably while the forming and shaping loads are still maintained.

Figure 5:
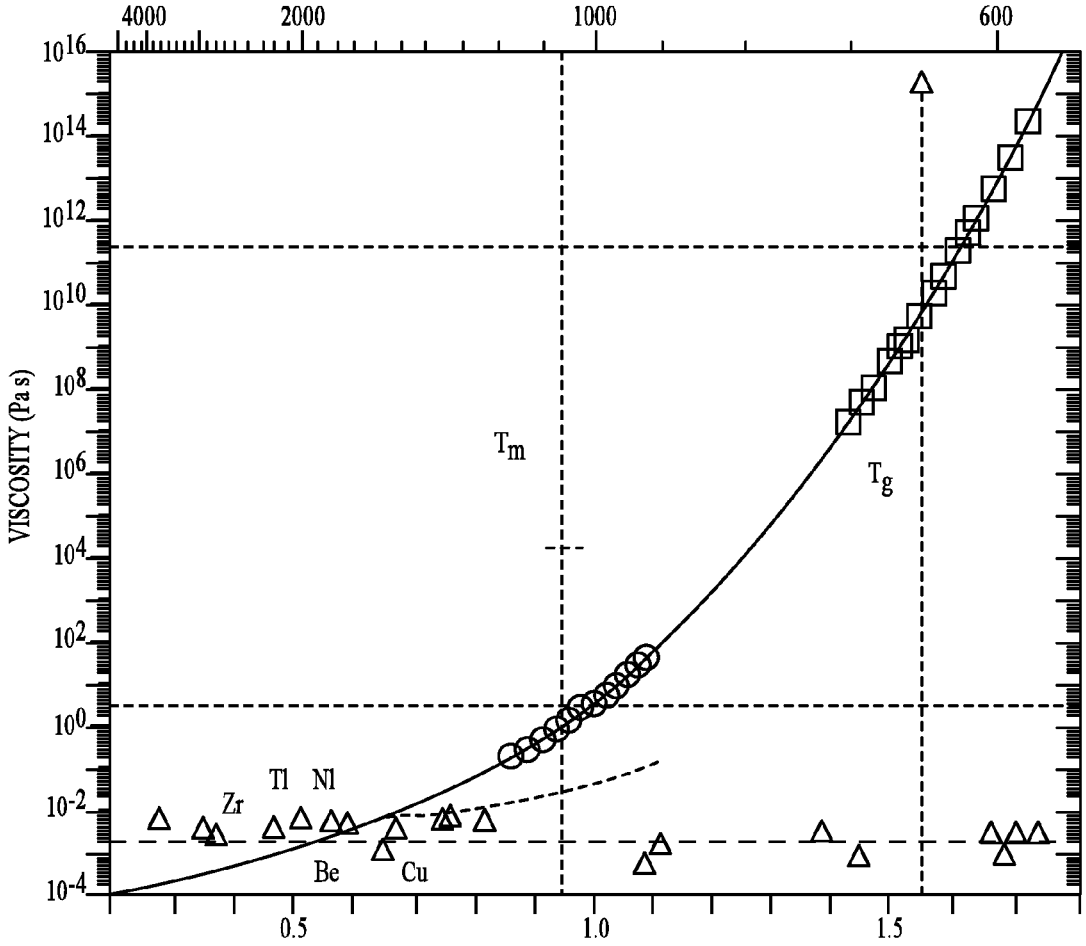
FIG. 5 depicts a temperature-viscosity diagram of an exemplary bulk solidifying metallic glass alloy.

FIG. 5 shows a viscosity-temperature graph of an exemplary bulk solidifying metallic glass-forming alloy, from an exemplary series of Zr—Ti—Ni—Cu—Be alloys manufactured by Liquidmetal Technology. It should be noted that there is no clear liquid/solid transformation for a bulk solidifying amorphous metal during the formation of an amorphous solid. The molten alloy becomes more and more viscous with increasing undercooling until it approaches solid form around the glass transition temperature. Accordingly, the temperature of solidification front for bulk solidifying metallic glass-forming alloys can be around glass transition temperature, where the alloy will practically act as a solid for the purposes of pulling out the quenched amorphous sheet product.

Figure 6:
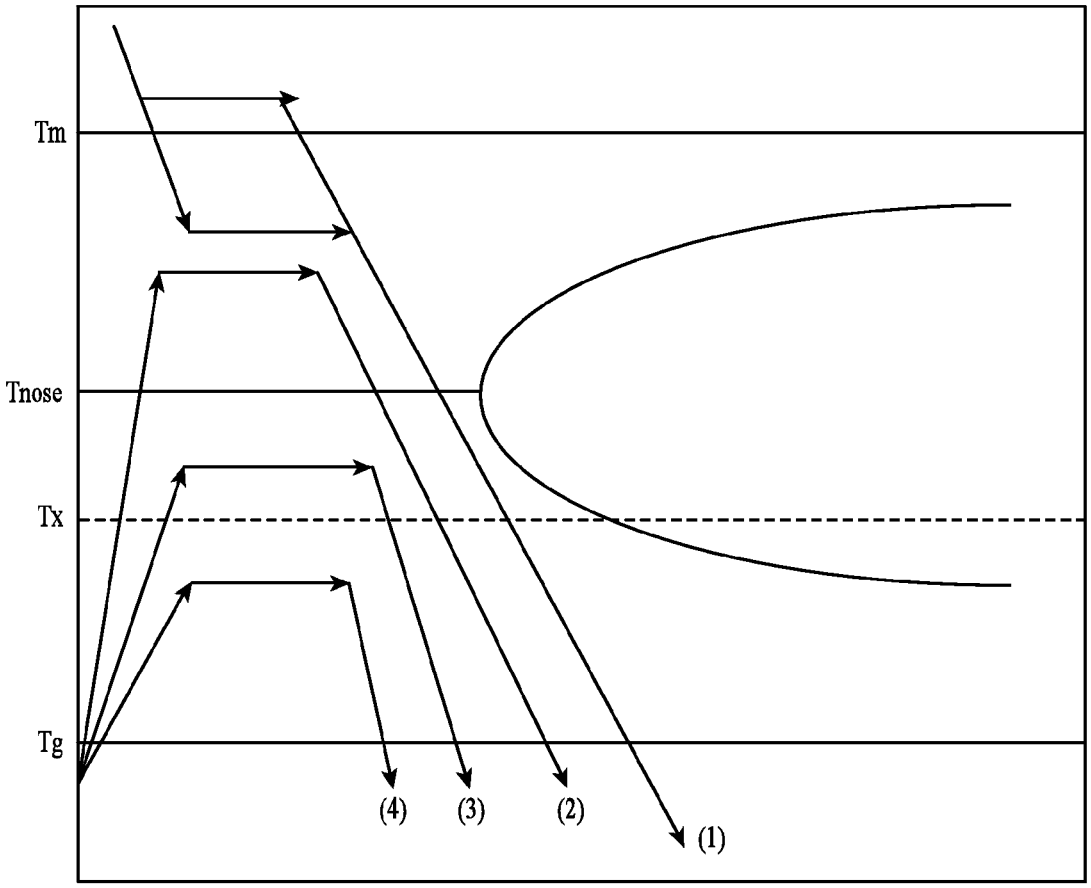
FIG. 6 depicts a schematic of a time-temperature-transformation (TTT) diagram for an exemplary bulk solidifying metallic glass alloy.

FIG. 6 shows the time-temperature-transformation (TTT) cooling curve of an exemplary bulk solidifying metallic glass-forming alloy, or TTT diagram. Bulk-solidifying amorphous metals do not experience a liquid/solid crystallization transformation upon cooling, as with conventional metals. Instead, the highly fluid, non-crystalline form of the metal found at high temperatures (near a "melting temperature" Tm) becomes more viscous as the temperature is reduced (near to the glass transition temperature Tg), eventually taking on the outward physical properties of a conventional solid.

Even though there is no liquid/crystallization transformation for a bulk solidifying amorphous metal, a melting temperature Tm may be defined as the thermodynamic liquidus temperature of the corresponding crystalline phase. FIG. 6 shows processing methods of die casting from at or above Tm to below Tg without example time-temperature trajectory (1) hitting the TTT curve. Time-temperature trajectories (2), (3), and (4) depict processes at or below Tg being heated to temperatures below Tm. Under this regime, the viscosity of bulk-solidifying amorphous alloys at or above the melting temperature Tm could lie in the range of about 0.1 poise to about 10,000 poise, and even sometimes under 0.01 poise. A lower viscosity at the "melting temperature" would provide faster and complete filling of intricate portions of the shell/mold with a bulk solidifying amorphous metal for forming the metallic glass parts. Furthermore, the cooling rate of the molten metal to form a metallic glass part has to such that the time-temperature profile during cooling does not traverse through the nose-shaped region bounding the crystallized region in the TTT diagram of FIG. 6. In FIG. 6, Tnose (at the peak of crystallization region) is the critical crystallization temperature Tx where crystallization is most rapid and occurs in the shortest time scale.

The supercooled liquid region, the temperature region between Tg and Tx is a manifestation of the stability against crystallization of bulk solidification alloys. In this temperature region the bulk solidifying alloy can exist as a high viscous liquid. The viscosity of the bulk solidifying alloy in the supercooled liquid region can vary between $10^{12}$ Pa s at the glass transition temperature down to $10^{5}$ Pa s at the crystallization temperature, the high temperature limit of the supercooled liquid region. Liquids with such viscosities can undergo substantial plastic strain under an applied pressure. The embodiments herein make use of the large plastic formability in the supercooled liquid region as a forming and separating method.

Technically, the nose-shaped curve shown in the TTT diagram describes Tx as a function of temperature and time. Thus, regardless of the trajectory that one takes while heating or cooling a metal alloy, when one hits the TTT curve, one has reached Tx. In FIG. 6, Tx is shown as a dashed line as Tx can vary from close to Tm to close to Tg.

The schematic TTT diagram of FIG. 6 shows processing methods of die casting from at or above Tm to below Tg without the time-temperature trajectory (shown as (1) as an example trajectory) hitting the TTT curve. During die casting, the forming takes place substantially simultaneously with fast cooling to avoid the trajectory hitting the TTT curve. The processing methods for superplastic forming (SPF) range from at or below Tg to below Tm without the time-temperature trajectory (shown as (2), (3) and (4) as example trajectories) hitting the TTT curve. In SPF, the amorphous bulk metallic glass is reheated into the supercooled liquid region where the available processing window could be much larger than die casting, resulting in better controllability of the process. The SPF process does not require fast cooling to avoid crystallization during cooling. Also, as shown by example trajectories (2), (3) and (4), the SPF can be carried out with the highest temperature during SPF being above Tnose or below Tnose, up to about Tm. If one heats up a piece of metallic glass-forming alloy but manages to avoid hitting the TTT curve, you have heated "between Tg and Tm," but one would have not reached Tx.

Typical differential scanning calorimeter (DSC) heating curves of bulk-solidifying metallic glass-forming alloys taken at a heating rate of 20 C/min describe, for the most part, a particular trajectory across the TTT data where one would likely see a Tg at a certain temperature, a Tx when the DSC heating ramp crosses the TTT crystallization onset, and eventually melting peaks when the same trajectory crosses the temperature range for melting. If one heats a bulk-solidifying metallic glass-forming alloy at a rapid heating rate as shown by the ramp up portion of trajectories (2), (3) and (4) in FIG. 6, then one could avoid the TTT curve entirely, and the DSC data would show a glass transition but no Tx upon heating. Another way to think about it is trajectories (2), (3) and (4) can fall anywhere in temperature between the nose of the TTT curve (and even above it) and the Tg line, as long as it does not hit the crystallization curve. That just means that the horizontal plateau in trajectories might get much shorter as one increases the processing temperature.

Any metallic glass-forming alloy in the art may be used in the methods described herein. As used herein, the terms metallic glass alloy, metallic glass-forming alloy, amorphous metal, amorphous alloy, bulk solidifying amorphous alloy, BMG alloy, and bulk metallic glass alloy are used interchangeably.

An amorphous or non-crystalline material is a material that lacks lattice periodicity, which is characteristic of a crystal. As used herein, an amorphous material includes glass which is an amorphous solid that softens and transforms into a liquid-like state upon heating through the glass transition. Generally, amorphous materials lack the long-range order characteristic of a crystal, though they can possess some short-range order at the atomic length scale due to the nature of chemical bonding. The distinction between amorphous solids and crystalline solids can be made based on lattice periodicity as determined by structural characterization techniques such as x-ray diffraction and transmission electron microscopy.

In one embodiment, a metallic glass-forming alloy composition can be homogeneous with respect to the amorphous phase. A substance that is uniform in composition is homogeneous. This is in contrast to a substance that is heterogeneous. A substance is homogeneous when a volume of the substance is divided in half and both halves have substantially the same composition. For example, a particulate suspension is homogeneous when a volume of the particulate suspension is divided in half and both halves have substantially the same volume of particles. However, it might be possible to see the individual particles under a microscope. Another example of a homogeneous substance is air, where different ingredients therein are equally suspended, though the particles, gases and liquids in air can be analyzed separately or separated from air. In various embodiments, the particle composition can vary, provided that the final amorphous material has the elemental composition of the metallic glass-forming alloy.

The methods described herein can be applicable to any type of suitable metallic glass-forming alloy. Similarly, the metallic glass-forming alloy described herein as a constituent of a composition or article can be of any type. As recognized by those of skill in the art, metallic glass-forming alloys may be selected based on and may have a variety of potentially useful properties. In particular, metallic glass-forming alloys tend to be stronger than crystalline alloys of similar chemical composition.

The alloy can comprise multiple transition metal elements, such as at least two, at least three, at least four, or more, transitional metal elements. The alloy can also optionally comprise one or more nonmetal elements, such as one, at least two, at least three, at least four, or more, nonmetal elements. A transition metal element can be any of scandium, titanium, vanadium, chromium, manganese, iron, cobalt, nickel, copper, zinc, yttrium, zirconium, niobium, molybdenum, technetium, ruthenium, rhodium, palladium, silver, cadmium, hafnium, tantalum, tungsten, rhenium, osmium, iridium, platinum, gold, mercury, rutherfordium, dubnium, seaborgium, bohrium, hassium, meitnerium, ununnilium, unununium, and ununbium. In one embodiment, a BMG containing a transition metal element can have at least one of Sc, Y, La, Ac, Ti, Zr, Hf, V, Nb, Ta, Cr, Mo, W, Mn, Tc, Re, Fe, Ru, Os, Co, Rh, Ir, Ni, Pd, Pt, Cu, Ag, Au, Zn, Cd, and Hg. Depending on the application, any suitable transitional metal elements, or their combinations, can be used.

Depending on the application, any suitable nonmetal elements, or their combinations, can be used. A nonmetal element can be any element that is found in Groups 13-17 in the Periodic Table. For example, a nonmetal element can be any one of F, Cl, Br, I, At, O, S, Se, Te, Po, N, P, As, Sb, Bi, C, Si, Ge, Sn, Pb, and B. Occasionally, a nonmetal element can also refer to certain metalloids (e.g., B, Si, Ge, As, Sb, Te, and Po) in Groups 13-17. In one embodiment, the nonmetal elements can include B, Si, C, P, or combinations thereof. Accordingly, for example, the alloy can comprise a boride, a carbide, or both.

In some embodiments, the alloy composition described herein can be fully alloyed. The term fully alloyed used herein can account for minor variations within the error tolerance. For example, it can refer to at least 90% alloyed, such as at least 95% alloyed, such as at least 99% alloyed, such as at least 99.5% alloyed, such as at least 99.9% alloyed. The percentage herein can refer to either volume percent or weight percentage, depending on the context. These percentages can be balanced by impurities, which can be in terms of composition or phases that are not a part of the alloy. The alloys can be homogeneous or heterogeneous, e.g., in composition, distribution of elements, amorphicity/crystallinity, etc.

The alloy can include any combination of the above elements in its chemical formula or chemical composition. The elements can be present at different weight or volume percentages. Alternatively, in one embodiment, the above-described percentages can be volume percentages, instead of weight percentages. Accordingly, a metallic glass-forming alloy can be zirconium-based, titanium-based, platinum-based, palladium-based, gold-based, silver-based, copper-based, iron-based, nickel-based, aluminum-based, molybdenum-based, and the like. The alloy can also be free of any of the aforementioned elements to suit a particular purpose. For example, in some embodiments, the alloy, or the composition including the alloy, can be substantially free of nickel, aluminum, titanium, beryllium, or combinations thereof. In one embodiment, the alloy or the composite is completely free of nickel, aluminum, titanium, beryllium, or combinations thereof.

Furthermore, the metallic glass-forming alloy can also be one of the exemplary compositions described in U.S. Patent Application Publication Nos. 2010/0300148 or 2013/0309121, the contents of which are herein incorporated by reference.

The metallic glass-forming alloys can also be ferrous alloys, such as (Fe, Ni, Co) based alloys. Examples of such compositions are disclosed in U.S. Pat. Nos. 6,325,868; 5,288,344; 5,368,659; 5,618,359; and 5,735,975, Inoue et al., Appl. Phys. Lett., Volume 71, p 464 (1997), Shen et al., *Mater. Trans., JIM*, Volume 42, p 2136 (2001), and Japanese Patent Application No. 200126277 (Pub. No. 2001303218 A). One exemplary composition is $Fe_{72}Al_5Ga_2P_{11}C_6B_4$. Another example is $Fe_{72}Al_7Zr_{10}Mo_5W_2B_{15}$. Another iron-based alloy system that can be used in the coating herein is disclosed in U.S. Patent Application Publication No. 2010/0084052, wherein the amorphous metal contains, for example, manganese (1 to 3 atomic %), yttrium (0.1 to 10 atomic %), and silicon (0.3 to 3.1 atomic %) in the range of composition given in parentheses; and that contains the following elements in the specified range of composition given in parentheses: chromium (15 to 20 atomic %), molybdenum (2 to 15 atomic %), tungsten (1 to 3 atomic %), boron (5 to 16 atomic %), carbon (3 to 16 atomic %), and the balance iron.

The afore described metallic glass-forming alloy systems can further include additional elements, such as additional transition metal elements, including Nb, Cr, V, and Co. The additional elements can be present at less than or equal to about 30 wt %, such as less than or equal to about 20 wt %, such as less than or equal to about 10 wt %, such as less than or equal to about 5 wt %. In one embodiment, the additional, optional element is at least one of cobalt, manganese, zirconium, tantalum, niobium, tungsten, yttrium, titanium, vanadium and hafnium to form carbides and further improve wear and corrosion resistance. Further optional elements may include phosphorous, germanium and arsenic, totaling up to about 2%, and preferably less than 1%, to reduce melting point. Otherwise incidental impurities should be less than about 2% and preferably 0.5%.

In some embodiments, a composition having a metallic glass-forming alloy can include a small amount of impurities. The impurity elements can be intentionally added to modify the properties of the composition, such as improving the mechanical properties (e.g., hardness, strength, fracture mechanism, etc.) and/or improving the corrosion resistance. Alternatively, the impurities can be present as inevitable, incidental impurities, such as those obtained as a byproduct of processing and manufacturing. The impurities can be less than or equal to about 10 wt %, such as about 5 wt %, such as about 2 wt %, such as about 1 wt %, such as about 0.5 wt %, such as about 0.1 wt %. In some embodiments, these percentages can be volume percentages instead of weight percentages. In one embodiment, the alloy sample/composition consists essentially of the metallic glass-forming alloy (with only a small incidental amount of impurities). In another embodiment, the composition includes a metallic glass-forming alloy (with no observable trace of impurities).

In other embodiments, metallic glass-forming alloys, for example, of boron, silicon, phosphorus, and other glass-formers with magnetic metals (iron, cobalt, nickel) may be magnetic, with low coercivity and high electrical resistance. The high resistance leads to low losses by eddy currents when subjected to alternating magnetic fields, a property useful, for example, as transformer magnetic cores.

In further embodiments, mixfunctional elements and alloys can be added to a metallic glass substrate by the methods disclosed herein. BMG composites of materials that were not able to be formed previously can be prepared in this manner. In some variations, the metallic glass-forming powder can be embedded with another material powder that imparts specific properties. For example, magnetic alloys and particles can be added to the metallic glass-forming powder, such that a non-magnetic metallic glass-forming alloy can be modified to exhibit magnetic properties. Likewise, particles of a ductile material can be added to stop crack tip propagation and improve the toughness of the composite. Heating methods disclosed herein can be used to make such materials by keeping the melted/heat affected zone localized and quiescent (e.g. by reducing mixing of elements between neighboring regions, imparting compositional change). In various aspects, different amounts of heat to each powder type to tune temperature exposure of each, for example by using a CCD to identify each powder type, or by the properties of the powder (e.g. reflectivity under particular wavelengths, heat capacity). In another variation, BMGs and other material powders can be added separately during each layering step.

The methods herein can be valuable in the fabrication of electronic devices using a BMG. An electronic device herein can refer to any electronic device known in the art. For example, it can be a telephone, such as a cell phone, and a land-line phone, or any communication device, such as a smart phone, including, for example an iPhone®, and an electronic email sending/receiving device. It can be a part of a display, such as a digital display, a TV monitor, an electronic-book reader, a portable web-browser (e.g., iPad®), watch and a computer monitor. It can also be an entertainment device, including a portable DVD player, conventional DVD player, Blue-Ray disk player, video game console, music player, such as a portable music player (e.g., iPod®), etc. It can also be a part of a device that provides control, such as controlling the streaming of images, videos, sounds (e.g., Apple TV®), or it can be a remote control for an electronic device. It can be a part of a computer or its accessories, such as the hard drive tower housing or casing, laptop housing, laptop keyboard, laptop track pad, desktop keyboard, mouse, and speaker. The article can also be applied to a device such as a watch or a clock.

The articles "a" and "an" are used herein to refer to one or to more than one (i.e., to at least one) of the grammatical object of the article. By way of example, "a polymer resin" means one polymer resin or more than one polymer resin. Any ranges cited herein are inclusive. The terms "substantially" and "about" used throughout this Specification are used to describe and account for small fluctuations. For example, they can refer to less than or equal to .±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

All publications, patents, and patent applications cited in this Specification are hereby incorporated by reference in their entirety.

While this invention has been described with reference to specific embodiments, it will be understood by those skilled in the art that various changes may be made and equivalents may be substituted for elements thereof, without departing from the spirit and scope of the invention. In addition, modifications may be made to adapt the teachings of the invention to particular situations and materials, without departing from the essential scope thereof. Thus, the invention is not limited to the particular examples that are disclosed herein, but encompasses all embodiments falling within the scope of the appended claims.

The invention claimed is:

1. A method of forming a metallic glass part comprising:

heating a metallic glass-forming alloy powder to a temperature over the $T_{liquidus}$ of the alloy to form a metallic glass-forming alloy melt;

quenching the metallic glass-forming alloy melt to a temperature below the glass-transition temperature;

forming a heat-treated metallic glass-forming alloy powder;

heating at least a portion of the heat-treated metallic glass-forming powder with an electron beam or laser to a temperature above the glass transition temperature of the alloy to form a fused metallic glass; and cooling the fused metallic glass to form the metallic glass part.

2. The method of claim 1 wherein the quenching and forming steps are simultaneous.

3. The method of claim 1 wherein the heat-treated metallic glass-forming alloy powder is heated to above the $T_{liquidus}$ in a time of less than 5 seconds.

4. The method of claim 2 wherein the metallic glass-forming alloy melt is gas atomized to form a heat-treated metallic glass-forming powder.

5. The method of claim 1 wherein the quenching and forming steps are consecutive.

6. The method of claim 1 wherein the metallic glass-forming alloy powder is heated to a temperature at least 25% greater than the $T_{liquidus}$ of the alloy.

7. The method of claim 1 wherein the metallic glass-forming alloy powder is heated to a temperature at least 40% greater than the $T_{liquidus}$ of the alloy.

8. The method of claim 1 wherein the metallic glass-forming alloy powder is heated to a temperature over the $T_{GFA}$ of the alloy, wherein the $T_{GFA}$ is the temperature associated with substantial improvement in glass-forming ability compared to the glass-forming ability demonstrated by heating the alloy melt above $T_{liquidus}$ of the alloy.

9. The method of claim 2 wherein the metallic glass-forming alloy melt is liquid atomized to form a heat-treated metallic glass-forming powder.

10. The method of claim 1, wherein the quenching is at a cooling rate sufficiently rapid to create an amorphous alloy.

11. The method of claim 1, wherein the heat-treated metallic glass-forming alloy powder is crystalline.

12. The method of claim 1, wherein the heat-treated metallic glass-forming alloy powder is amorphous.

13. The method of claim 1, wherein the heat-treated metallic glass-forming alloy powder is a combination of crystalline and amorphous.

14. The method of claim 1 wherein forming a heat-treated metallic glass alloy powder comprises milling the quenched metallic glass-forming alloy melt.

15. The method of claim 1, further comprising:

depositing a layer of heat-treated metallic glass-forming alloy powder onto a metallic glass layer prior to heating at least a portion of the metallic glass-forming powder.

16. A method of forming a metallic glass composite comprising:

depositing a layer of metallic powder, a portion of which is a metallic glass-forming alloy and a portion of which is a non-metallic glass-forming material;

locally heating the metallic glass-forming alloy portion at a first temperature and heating the non-metallic glass-forming material portion at a second temperature, and cooling the heated metallic glass-forming alloy portion and non-metallic glass-forming powder material to fuse the layer of metallic powder and form the metallic glass composite.

17. The method of claim 16, where the non-metallic glass-forming material is a magnetic alloy.

18. The method of claim 16, where the non-metallic glass-forming material is a ductile alloy.

* * * * *